US006948351B2

(12) United States Patent
Norin

(10) Patent No.: US 6,948,351 B2
(45) Date of Patent: Sep. 27, 2005

(54) TONGS THAT INCLUDE A LINK ARM MECHANISM WHERE THE LENGTH OF ONE LINK IS ADJUSTABLE

(75) Inventor: Mats Norin, Älvdalen (SE)

(73) Assignee: Pressmaster AB, Alvdalen (SE)

( * ) Notice: Subject to any disclaimer, the term of this patent is extended or adjusted under 35 U.S.C. 154(b) by 90 days.

(21) Appl. No.: 10/736,562

(22) Filed: Dec. 17, 2003

(65) Prior Publication Data

US 2004/0129116 A1 Jul. 8, 2004

(30) Foreign Application Priority Data

Dec. 20, 2002 (SE) ..... 0203797

(51) Int. Cl.[7] ..... B21D 7/06

(52) U.S. Cl. ..... 72/409.12; 72/409.01; 29/751; 81/313; 81/382; 81/384

(58) Field of Search ..... 72/409.01, 409.12; 29/751; 81/313, 382, 383, 383.5, 384, 392, 356

(56) References Cited

U.S. PATENT DOCUMENTS 1,354,755 A * 10/1920 Hultman ..... 30/250
2,498,235 A * 2/1950 Barber ..... 81/384
4,158,302 A * 6/1979 O'Loughlin ..... 72/409.16
5,042,286 A * 8/1991 Wiebe et al. ..... 72/414
5,870,925 A * 2/1999 Morris et al. ..... 72/409.12
6,073,472 A * 6/2000 Hollingsworth ..... 72/31.01
6,212,932 B1 * 4/2001 Parker ..... 72/409.12

FOREIGN PATENT DOCUMENTS

DE 25 55 071 6/1977

* cited by examiner

*Primary Examiner*—Daniel C. Crane
(74) *Attorney, Agent, or Firm*—Jacobson Holman PLLC

(57) ABSTRACT

Tongs comprising a four link mechanism (12, 20, 22, 30) wherein the links are pivotally connected together by means of parallel pivot joints (23', 24', 31', 32'), wherein the link mechanism includes two mutually connected links (20, 30) which define therebetween an angle that approaches 180° at the closing end position of the tongs, and wherein the length of one (30) of said two links is adjustable and includes two parts that are moveable in the longitudinal direction of the link, wherein the first (36) of said parts includes a slot (51) for guiding a a shaft (31) carried by said second part (70) and belonging to the pivot joint of the adjustable link (30). The shaft (31) carries a rounded body (50) that has mutually discrete first formations disposed around its periphery, said formations being located at mutually different distances from the shaft (31) about which the second part (70) is rotatable, wherein the first part (36) includes on the longitudinal axis of the length adjustable link (30) a second formation (38) that is generally complimentary to the first formations (33) for engagement with one of said formations.

6 Claims, 2 Drawing Sheets

TONGS THAT INCLUDE A LINK ARM MECHANISM WHERE THE LENGTH OF ONE LINK IS ADJUSTABLE

The present invention relates tongs of the kind defined in the preamble of the accompanying claim 1.

More specifically, the invention relates to tongs in the form of a hand-operated crimping tool, i.e. a tool for pressing cable shoes, cable sleeves and the like into electrical contact with the end of a cable conductor in particular.

The invention thus relates to tongs of the kind known, for instance, from DE 2-555071 C2. Tongs of this known kind comprise a link mechanism that preferably includes four links which are pivotally connected to one another by pivot joints to form a closed link ring. Two of the links have a respective handgrip leg fixedly connected thereto and two of the links each carry a respective clamping jaw, said jaws forming the crimping elements of the tool. A first link can be extended at both ends so that one end part will form one clamping/crimping jaw and its other end will form one of said handgrip legs. That part of a second link connecting with the first link has an extension which forms the second clamping/crimping jaw of the tongs. A third link connecting with the second link has a handgrip-leg fixedly connected thereto. A fourth link connects between the third and the first links. The geometry of the link mechanism is preferably such that the third and fourth links will approach each other axially as the jaws are brought together. This enables extremely high clamping forces to be applied manually between the jaws in the final closing moments of tongs, although the mutual pivot points of the third and fourth links should not, of course, pass the dead centre position for practical reasons. Optimisation of the link mechanism enables relatively heavy work to be carried out manually during closing of the tongs.

Since very large forces will be transferred through the third and the fourth links as they approach each other axially, the links and the pivot joints therebetween will experience a great deal of resilience and clearances/play between the same will be eliminated. Consequently, in order to establish a high clamping force between the jaws it is therefore appropriate to adjust the effective length of the third and the fourth link. In this regard it is known to include in one of the joints of the mechanism, and then particularly in one of the pivot joints of the fourth link, an eccentric device that has an eccentric sleeve which is pivotally mounted in one of the links and receives a shaft belonging to the adjacent link connected thereto. The effective length of the connecting link can be adjusted, by rotating the sleeve in its mounting. It is also known to provide the eccentric sleeve with a round end plate whose periphery is coaxial with the rotational axis of the sleeve bearing and with which the sleeve can be locked in a set position of rotation. The end plate has a number of discrete recesses around at least part of its circumference and a selected recess can be brought into engagement with a locking pin located in a fixed position.

It is also known to provide such tongs with a latching mechanism which ensures that the closing movement of the tongs will be completed before the jaws re-open. This latching mechanism may include a cam, which possibly includes a row of teeth and which co-acts with a displaceable spring loaded latching element. During closing of the jaws, the latching element is displaced so as to allow closing of the jaws to continue, but prevents commencement of the opening movement of the mechanism, by co-action with the cam, until the mechanism/the clamping jaws have reached a predetermined end position, at which the row of teeth is switched to enable the link mechanism/the jaws to be opened. The latching element is adapted to begin prevention of a jaw opening movement again, for instance when said element begins to engage the cam. Such a latching mechanism is known from DE 2-555071 C2 for instance.

We have found that an eccentric arrangement of the aforesaid kind has a number of drawbacks. Because of the high loads that are transferred to the eccentric sleeve, the sleeve will be subjected to a relatively high torque in the majority of its positions of rotation. This torque places demands on latching the sleeve against rotation. The means with which the known eccentric sleeve is latched is complex both with regard to its structural design and also with regards to its manual use. Moreover, as a result of the nature of the sleeve, equidistantly spaced recesses around the circumference of the end plate represent different changes in the effective length of the link concerned.

Accordingly, an object of the present invention is to avoid these drawbacks either completely or partially, by providing tongs with a novel arrangement for adjusting the effective length of one of its links.

This object is achieved by means of the present invention.

The invention is defined in the accompanying claim 1.

Further embodiments of the invention will be apparent from the accompanying dependent claims.

The invention will now be described by way of example with reference to the accompanying drawings.

Figure 1:
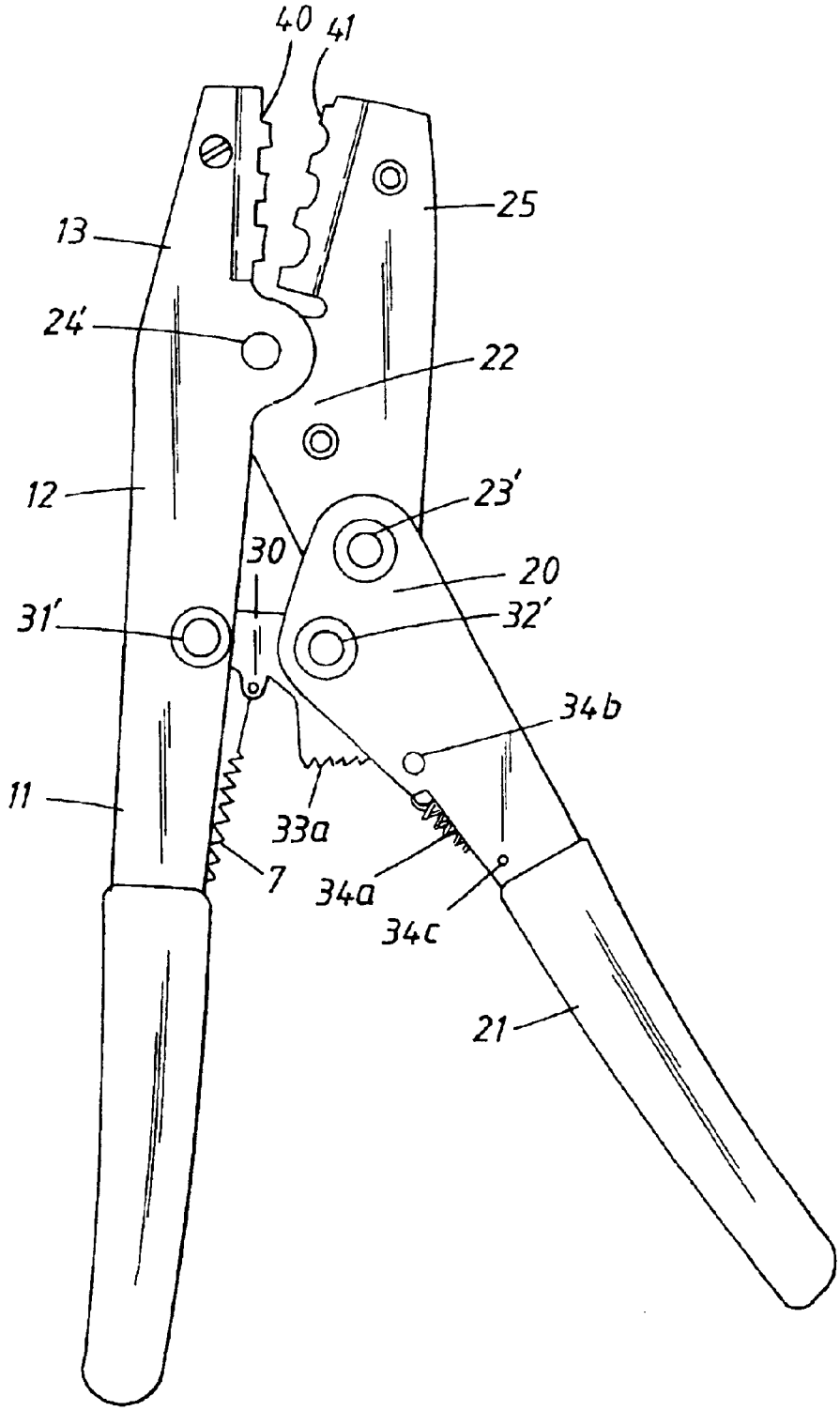
FIG. 1 is a schematic side view of earlier known tongs.

FIG. 1 illustrates electric contact pressing tongs comprising four links 12, 22, 20, 30 which are mutually connected by joints 24', 23', 32', 31'. The links 12, 22 have extensions 13, 25 which form clamping jaws to which electrical contact pressing elements 40, 41 may be fitted. The links 20 and 12 have extensions that form handgrip legs 11, 21.

Figure 2:
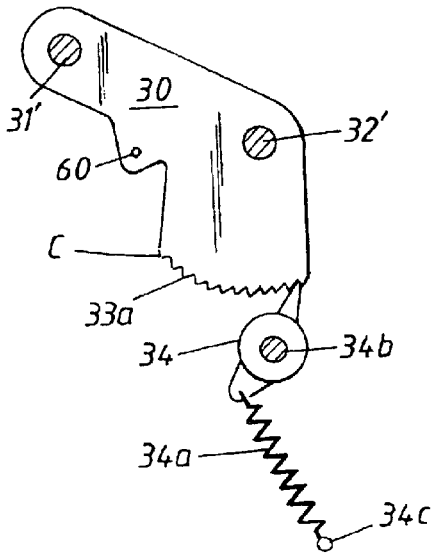
FIG. 2 illustrates part of the tongs shown in FIG. 1.

In the closing position of the tongs, the links 20, 30 approach each other in an axial direction, i.e. the joint 32 approaches a line that connects the joints 23', 31'. A draw spring 7 is connected between the link 30 and the leg 11 so as to bias the jaws of the tongs towards their open state. FIG. 2 shows the shafts 31, 32 of the joints, and also the spring attachment opening 60 and a cam 33*a*, which is toothed and co-axial with the joint 32'. A cross-tooth 34 is pivotally mounted on a shaft 34*b* for engagement with the cam 33*a*. The tooth is rotationally biased by a spring 34*a* anchored to the handgrip leg 21 at point 34*c*. It will be seen from the geometry that the cross-tooth will run along the cam 34 and therewith enable the jaws to close while preventing opening of the tongs until the tooth reaches the end C of the cam, at which point the tooth is switched under the influence of spring 34*a* and therewith enable the jaws to open. According to the invention the link 30 consists of two parts 36 and 70 respectively. The part 36 carries a shaft 32 which is mounted in the link 20 and which also carries the cam 33*a*. The part 36 also includes a slot 51 that is elongate in a direction towards the bore 56/the axle 32.

The other part 70 of the link includes the shaft 31 and carries a rounded body 50 which is provided with discrete recesses 33 around its periphery. The recesses 33 are preferably spaced at mutually the same angular distance α from the shaft 31. Mutually adjacent recesses in the peripheral direction of said body vary with regard to their distance R from the shaft 31. The bottoms of the recesses 33 preferably lie around a spiral path around the axis of the shaft 31.

Figure 3:
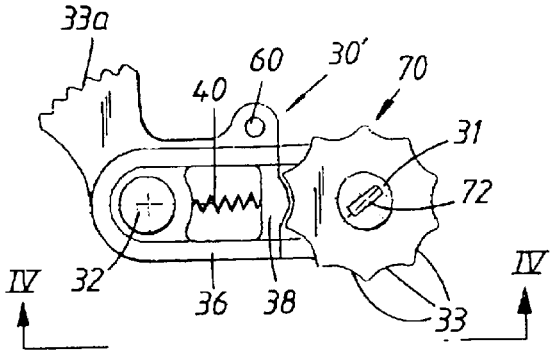
FIG. 3 illustrates a link 30' according to the invention, which may replace the link 30 in the tongs shown in FIG. 1.
Figure 6:
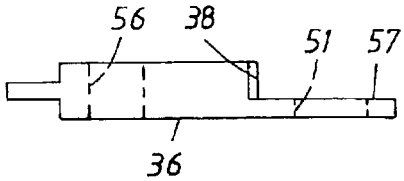
FIG. 6 is a view taken on line VI—VI in FIG. 5.
Figure 4:
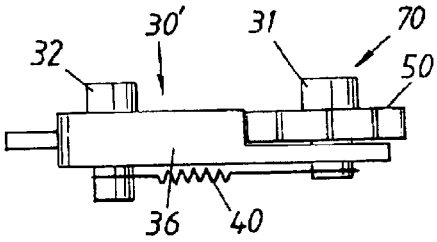
FIG. 4 is a view taken on the line IV—IV in FIG. 3.
Figure 7:
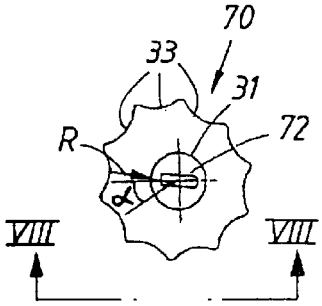
FIG. 7 is a plan view of a further part of the link shown in FIG. 3.
Figure 5:
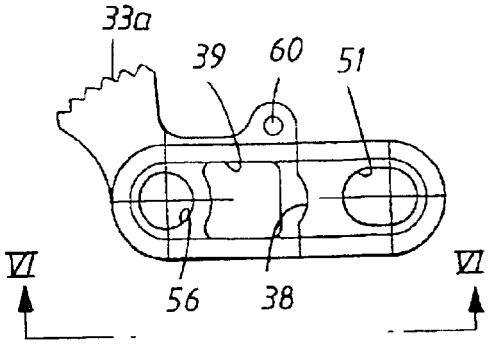
FIG. 5 shows part of the link according to FIG. 3.
Figure 8:
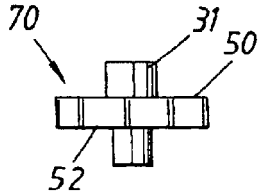
FIG. 8 is a view taken on the line VIII—VIII in FIG. 7.

It will be seen from FIGS. 3 and 4 that the shaft 31 of the part 70 extends through the slot 51 of the part 36 and is guided by the slot towards and away from the shaft 32. The part 36 also includes a shoulder 57 on which one major surface 52 of the body 50 rests. The part 36 of said link carries a curved projection 38 adjacent the axis of said part 36, i.e. a line that connects the centres of the openings 56, 51—The projection 38 is complimentary to the recesses 33.

A draw spring 40 is connected to the shafts 31, 32 and functions to draw the parts 36, 70 together in the axial direction of the link 30. It will be seen that a recess or notch 33 on the body 50 co-acts with the projection 38 along the long axis of the link 30. The body 50 will not therefore be subjected to torque about its shaft 31 when the link 30 is subjected to thrust forces.

Because the bottoms of the recesses 33 can be placed at selected distances from the rotational axis of the shaft 31, it is possible to place the equidistantly spaced recesses 33 around said periphery such that said recesses will be tangential to a spiral relative to the axis of the joint 31. As a result, each rotational increment of the body 50 will represent identical changes in the effective length of the link 30.

The shaft 31 is preferably fixedly connected to the body 50 and may include at one end a screwdriver slot 72 that can be seen externally of the tongs. When the tongs are free of load, the body 50 can be turned easily by an operator with the aid of a screwdriver to adjust the closing position of the tongs, provided that the formations 33, 38 and the bias of spring 40 will so allow.

The leg 12 of the tongs will normally comprise two mutually parallel plates which receive the end portion of the link therebetween and which hold together the parts of the adjustable link in the axial direction of the joints 31, 32.

What is claimed is:

1. Tongs comprising a four link mechanism (12, 20, 22, 30) wherein the links are pivotally connected together by means of parallel pivot joints (23', 24', 31', 32') wherein the link mechanism includes two mutually connected links (20, 30) which define therebetween an angle that approaches 180° at a closing end position of the tongs, and wherein the length of one (30) of said two links is adjustable, characterized in that the length adjustable link (30) includes two parts that are moveable in the longitudinal direction of the link, wherein the first (36) of said parts includes a slot (51) for guiding a pivot shaft (31) carried by said second part (70) and belonging to the pivot joint of the adjustable link (30), and wherein the pivot shaft (31) carries a rounded body (50) that has mutually discrete first formations disposed around its periphery, said formations being located at mutually different distances from the pivot shaft (31) about which the second part (70) is rotatable; and in that the first part (36) includes on the longitudinal axis of the length adjustable link (30) a second formation (38) that is generally complimentary to the first formations (33) for engagement with one of said formations.

2. Tongs according to claim 1 characterised in that peripherally adjacent first formations (33) have mutually the same angular distance around the pivot axis of the second part (70); and in that the distance of the first formations to the pivot axis of said first part is selectable.

3. Tongs according to claim 2 characterised in that the first formations are disposed around a spiral path that is centred on the pivot axis of the second part (70).

4. Tongs according to claim 1 characterised in that the first formations (33) and the second formation (38) have generally the form of mutually co-acting arcs of a circle.

5. Tongs according to claim 1 characterised in that body (50) carried by said second part (70) has a side surface (52) that rests on an abutment surface (57) on said first part; and in that the two pivot axes of the adjustable link are mutually parallel.

6. Tongs according to claim 1 characterised in that the first part (36) of the adjustable link carries a cam (33*a*) that forms part of a latching mechanism (33*a*, 34).

* * * * *